US006318263B1

(12) United States Patent
De Vroome

(10) Patent No.: US 6,318,263 B1
(45) Date of Patent: Nov. 20, 2001

(54) COOLING AND MOISTENING UNIT FOR ROTARY PRINTING MACHINES

(75) Inventor: Clemens Johannes Maria De Vroome, Beugen (NL)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/556,411

(22) Filed: Apr. 24, 2000

(30) Foreign Application Priority Data

Apr. 21, 1999 (DE) ..... 199 18 130

(51) Int. Cl.[7] ..... B41F 35/00
(52) U.S. Cl. ..... 101/424.1; 101/488; 34/92
(58) Field of Search ..... 101/216, 219, 101/228, 424.1, 483, 487, 488; 34/92, 393, 124, 447

(56) References Cited

U.S. PATENT DOCUMENTS

| | | | | |
|---|---|---|---|---|
| 3,198,199 | | 8/1965 | Schultz . | |
| 3,647,525 | | 3/1972 | Dahlgren . | |
| 4,120,349 | * | 10/1978 | Alheid | 34/124 |
| 4,231,164 | * | 11/1980 | Barbee | 34/92 |
| 4,567,673 | | 2/1986 | Böhnensieker | 101/424.1 |
| 4,646,540 | * | 3/1987 | Blackwood et al. . | |
| 4,833,794 | * | 5/1989 | Stibbe et al. | 101/424.1 |
| 4,920,881 | * | 5/1990 | Tafel | 101/488 |
| 5,471,847 | * | 12/1995 | Murray et al. | 34/393 |
| 5,588,224 | * | 12/1996 | Gianforte et al. | 34/447 |
| 5,596,930 | | 1/1997 | Keller et al. . | |
| 5,642,671 | * | 7/1997 | Winheim | 101/424.1 |
| 5,676,754 | * | 10/1997 | Helms et al. | 101/187 |
| 5,810,957 | * | 9/1998 | Boswell | 156/220 |
| 5,913,716 | * | 6/1999 | Mucci et al. | 451/59 |
| 5,918,541 | * | 7/1999 | Ahnen | 11/483 |
| 5,927,196 | * | 7/1999 | Murray | 101/219 |
| 6,058,844 | * | 5/2000 | Niemiec | 101/488 |

FOREIGN PATENT DOCUMENTS

| | | | | |
|---|---|---|---|---|
| 29 47 785 A1 | | 6/1981 | (DE) . | |
| 31 28 430 C2 | | 4/1984 | (DE) . | |
| 44 35 275 A1 | | 5/1995 | (DE) . | |
| 44 31 252 A1 | | 3/1996 | (DE) . | |
| 196 23 657 A1 | | 12/1997 | (DE) . | |
| 197 10 124 A1 | | 9/1998 | (DE) . | |
| 2947785 | * | 6/1981 | (DE) | 101/424.1 |
| 3239868 | * | 5/1984 | (DE) | 101/424.1 |
| 0 396 173 A1 | | 11/1990 | (EP) . | |
| 0 699 529 A1 | | 3/1996 | (EP) . | |
| 0 627 311 B1 | | 7/1998 | (EP) . | |
| 000283722 | * | 9/1988 | (EP) | 101/424.1 |
| 0291841 | * | 11/1988 | (EP) | 101/487 |
| 2 102 344 A | | 2/1983 | (GB) . | |
| 09174815 | | 7/1997 | (JP) . | |
| 10-202839 | | 8/1998 | (JP) . | |

* cited by examiner

*Primary Examiner*—Eugene Eickholt
(74) *Attorney, Agent, or Firm*—Herbert L. Lerner; Laurence A. Greenberg; Werner H. Stemer

(57) ABSTRACT

The combination of a cooling and conditioning unit for a material web to which ink is applied on at least one side thereof, having a multiplicity of chill rolls arranged in a housing at least approximately vertically above one another, utilizing the height of the housing, the material web being guidable around the chill rolls along a web path extending at least approximately vertically, and a dryer disposed upline from the cooling and conditioning unit for drying the material web, includes a material web outlet formed in the dryer, and a material web inlet formed in the cooling and conditioning unit, the cooling and conditioning unit being disposed immediately downline of the dryer in a manner that the material web leaving the dryer outlet immediately enters the inlet formed in the cooling and conditioning unit.

13 Claims, 1 Drawing Sheet

COOLING AND MOISTENING UNIT FOR ROTARY PRINTING MACHINES

BACKGROUND OF THE INVENTION

FIELD OF THE INVENTION

The present invention relates to a cooling and moistening unit for rotary printing machines, in particular for rotary printing machines for processing material webs.

The published German Patent Document DE 44 35 275 A1 concerns a device and a method for processing a material web. A device for dissipating heat from a web includes a chill roll with a cylindrical outer surface. The web is moved along a path which extends partly around the chill roll. Between the two side parts of the web, a nozzle extends in the circumferential direction around part of the cylindrical outer surface of the chill roll. Through the central part of the nozzle, an air flow is directed towards a central part of the web, specifically above a location at which the web normally comes into contact with the chill roll, in order to cause the central part of the web to sag and in this way to bring that part into contact with the chill roll. Lateral nozzle parts extend to both sides of the central part of the nozzle, specifically underneath the location at which the central part of the web is caused to sag in the direction of the chill roll. As a result, smoothing is achieved in the transverse direction and along the central part of the web.

The published German Patent Document DE 197 10 124 A1 concerns a method and a device for controlling the temperature of chill rolls. The publication relates to the cooling of a printed or coated material web, which, in particular, has been printed by the offset printing process and is formed of paper. After the application of ink, the material web has passed through a heating zone and is led over a multiplicity of chill rolls of a chill-roll stand. In this regard, the flow of the cooling medium through the chill rolls of a chill-roll stand is produced by two different cooling circuits at different temperature levels and is directed over the chill rolls counter to the web running direction of a material web. In this embodiment, the chill rolls are arranged in a conventional manner, taking up a considerable amount of construction and erection space, and only two of the chill rolls are arranged above one another.

The published European Patent Document EP 0 627 311 B1 is concerned with a web cooling device. The device according to this publication permits the cooling of a printing-material web heated in a dryer of a web-fed printing machine, using a supporting roll or turning device disposed downline of the dryer and guiding the printing-material web. By means of a second roll disposed downline of the supporting roll or turning device and guiding the printing-material web, with a first liquid applicator roll for applying liquid to a first side of the printing-material web, and a second liquid applicator roll for applying liquid to a second side of the printing-material web. The liquid applicator rolls are arranged on mutually opposite sides of the printing-material web, between the supporting roll or the turning device and the second roll. According to the disclosed device, the liquid applicator rolls are together assigned to a section of the printing-material web travelling between the supporting roll or turning device and the second roll, and are arranged to be offset relative to one another. They produce a pressure contact with the printing-material web along a contact surface in such a manner that dampening of the printing-material web surfaces can be effected.

However, by this proposed construction according to the published European Patent Document EP 0 627 311 B1, only a limited number of chill rolls can be accommodated in one chill-roll stand, as a result of which the effectiveness of the device for cooling remains limited, whereby a low temperature, at which a cooled material web is supposed to leave the device according to this published patent document, is difficult to achieve.

In the course of the general technical development in the printing sector, web speeds have continuously increased. Consequently, longer dryers and longer chill-roll units have now become necessary in order to achieve the drying of the printed material web and the cooling of the heated material web within an acceptable time interval following drying. From the indicated development, there results the problem, on the one hand, of reaching higher printing-machine speeds and, on the other hand, of keeping the lengths of dryers or cooling and redampening units, respectively, within a tolerable length with regard to the costly adjusting or erection area in print shops or printing plants.

SUMMARY OF THE INVENTION

In view of the improvements provided in the prior art and the development outlined hereinabove, it is an object of the invention to provide a cooling and moistening unit for rotary printing machines wherein the length of a cooling and conditioning unit is considerably shortened and, simultaneously, the effectiveness of the cooling is increased.

It is a further object of the invention to provide such a cooling and moistening unit by which the erection area required in a printing plant or print shop for such a cooling and conditioning unit is corrected to a great extent.

It is yet another object of the invention to provide such a cooling and conditioning unit which prevents the material web from running out laterally as the material web passes through the cooling and conditioning unit.

With the foregoing and other objects in view, there is provided, in accordance with one aspect of the invention, in combination, a cooling and conditioning unit for a material web to which ink is applied on at least one side thereof, having a multiplicity of chill rolls arranged in a housing at least approximately vertically above one another, utilizing the height of the housing, the material web being guidable around the chill rolls along a web path extending at least approximately vertically, and a dryer disposed upline from the cooling and conditioning unit for drying the material web, comprising a material web outlet formed in the dryer, and a material web inlet formed in the cooling and conditioning unit, the cooling and conditioning unit being disposed immediately downline of the dryer in a manner that the material web leaving the dryer outlet immediately enters the inlet formed in the cooling and conditioning unit.

In accordance with another feature of the invention, the housing of the cooling and conditioning unit directly adjoins a housing of the dryer disposed upline therefrom.

In accordance with a further feature of the invention, the housing of the cooling and conditioning unit is integrated in the dryer housing.

In accordance with an added feature of the invention, the chill rolls are arranged so as to be offset from one another.

In accordance with an additional feature of the invention, the chill rolls are arranged so as to be offset from one another with respect to the height of the housing.

In accordance with yet another feature of the invention, the chill rolls are arranged so as to be offset from one another with respect to the length of the housing.

In accordance with yet a further feature of the invention, the chill rolls are arranged in pairs above one another in a plane extending at least approximately vertically.

In accordance with yet an added feature of the invention, the cooling and conditioning unit includes two conditioning rolls disposed opposite one another, for applying a liquid film to the material web.

In accordance with yet an additional feature of the invention, as viewed in the travel direction of the material web, the conditioning rolls are disposed between the first chill roll and further chill rolls.

In accordance with still another feature of the invention, the chill rolls have a diameter less than 300 mm.

In accordance with still a further feature of the invention, at least some of the chill rolls are motor-driven.

In accordance with still an added feature of the invention, at least some of the chill rolls are freely rotatable, non-driven rolls.

In accordance with another aspect of the invention, there is provided a dryer for drying a printed material web in a web-fed rotary printing machine, comprising a multiplicity of chill rolls arranged in a housing of the dryer, at least approximately vertically above one another, utilizing the height of the housing, in such a manner that the material web is guidable around the chill rolls along a web path extending at least approximately vertically.

In accordance with a concomitant feature of the invention, the dryer includes two conditioning rolls disposed opposite one another, for applying a liquid film to the material web.

Of the many advantages associated with the invention of the instant application, the saving of erection area in a printing plant or print shop should be mentioned in particular. Because of the approximately vertical arrangement of a multiplicity of chill rolls, the web wraps around the surfaces thereof at wrap angles between 180° and 270°, which means that very effective heat transfer can be achieved. Because the diameter of the chill rolls according to the invention is relatively small in comparison with the width thereof, a high web tension can be maintained without additional tensioning devices, such as additional tensioning rolls, or nozzle arrangements that increase the web tension that is required. Because boundary layers can be eliminated virtually completely from the surfaces of the rapidly moving material web, the build-up of air cushions and the associated occurrence of condensation on the first chill rolls can largely be avoided.

According to further refinements of the concept upon which the invention is based, the chill rolls can be arranged offset from one another, in order to impress an at least approximately arcuate path on the material web passing therethrough, and to realize high wrap angles. The chill rolls according to the invention of the instant application can be arranged so as to be offset in relation to one another, specifically offset both in terms of height and offset in relation to one another with respect to the length of the housing. As a result of the offset arrangement and the application of an at least approximately arcuate material-web path, high wrap angles can be achieved at the chill rolls, as a result of which a particularly effective heat transfer is established.

It is optionally possible for the cooling and conditioning unit according to the invention to include a conditioning unit for applying a liquid, for example moisture, i.e., water, or silicone, to one or both sides of the material web passing through the conditioning unit. The conditioning rolls of the conditioning unit can be arranged opposite one another and can have either a common liquid container or a divided liquid container, in order to provide a constant liquid supply to the abovementioned surfaces.

In order to ensure the highest possible web tension during the transfer of a material web through the cooling and conditioning unit, the chill rolls according to the invention have a relatively small diameter in relation to the width thereof, i.e., between 100 mm and 250 mm, preferably about 250 mm. The relatively small diameter of the chill rolls according to the invention permits a high level of tension force to be maintained between the material web and the surfaces of the chill rolls, little air being included between the surface of the rolls and the material web. This in turn benefits the heat transfer coefficient and permits the elimination of the buckling or warping of the material web across the web width as it passes through the chill rolls in the material web travel direction.

The arrangement of the chill rolls according to the invention above one another within the housing utilizes the overall height thereof very effectively, as compared with the housings disclosed in the prior art. The utilization of the height of such a housing instead of the length thereof permits a short overall length and thus a small erection area in the printing plant or print shop.

Because the cooling and conditioning unit according to the invention is disposed relatively close to the following turner-bar or angle-bar superstructure, only a small free path for the post-evaporation or re-evaporation of solvents is possible, which additionally restricts the post-evaporation or re-evaporation thereof, so that the operating personnel are not exposed to any additional solvent loading of the air they breathe. The cooling and conditioning unit according to the invention can be assigned to a dryer in a rotary,printing machine, both for jobbing printing and for colored newspaper printing.

Other features which are considered as characteristic for the invention are set forth in the appended claims.

Although the invention is illustrated and described herein as embodied in cooling and moistening unit for rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, wherein:

DESCRIPTION OF THE PREFERRED EMBODIMENTS

Figure 1:
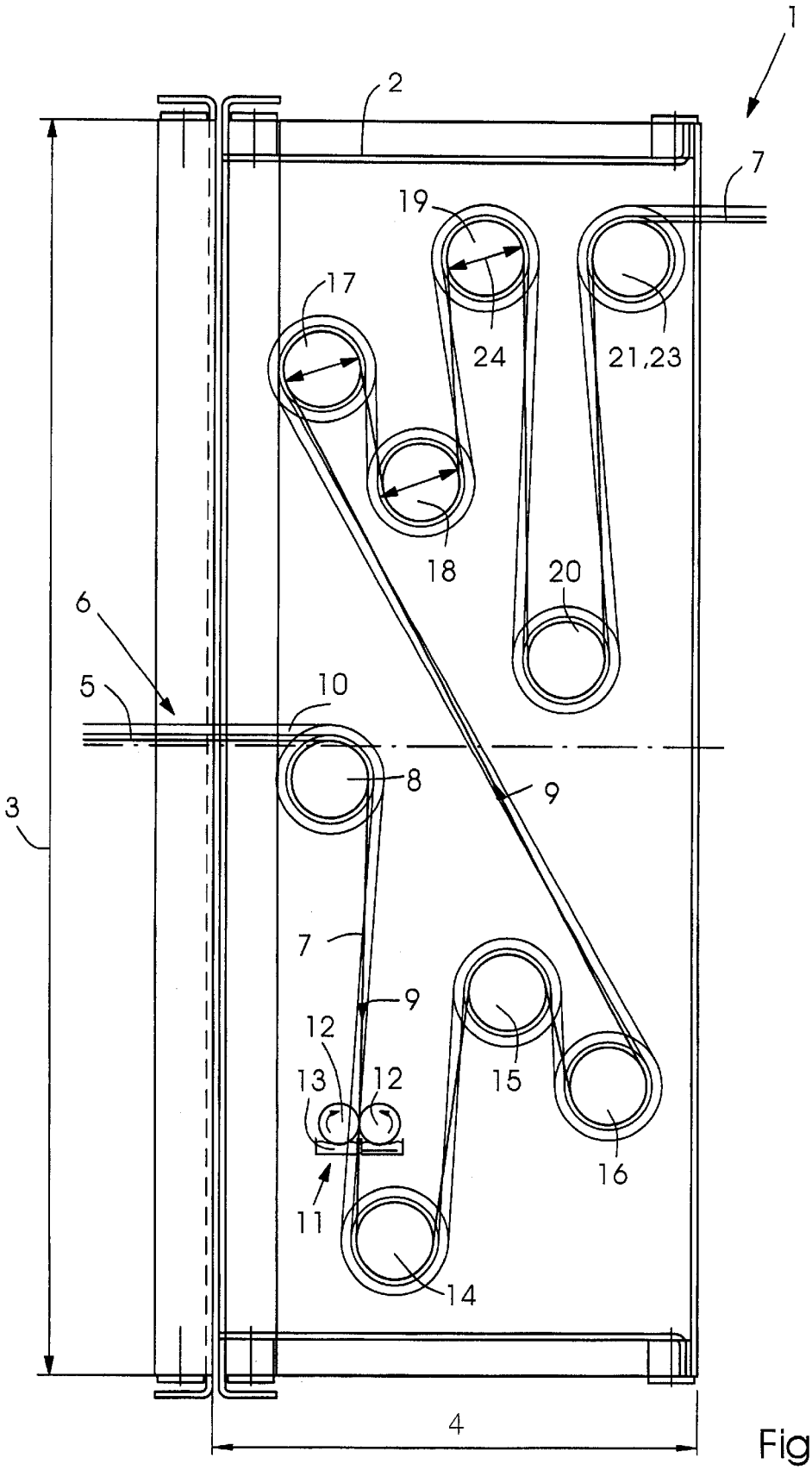
FIG. 1 is a diagrammatic longitudinal sectional view of a cooling and conditioning unit according to the invention.

Referring now to the single figure of the drawing, namely FIG. 1, there is shown therein a cooling and conditioning unit 1 according to the invention disposed directly downline of the outlet of a dryer. The dryer has an appropriate upper dryer zone and an appropriate lower dryer zone, between which there extends a web travel plane. The cooling and conditioning unit 1 includes a first chill roll 8 having a diameter 24. The material web 7, of which either one or both sides have been printed, is deflected 90° by the first chill roll 8 and follows a material web path which extends downwardly and which leads the material web 7 in a web travel direction 9. In the further course of this part of the web travel path, extending downwardly, a conditioning unit 11 is optionally provided, which permits the application of water or of another fluid, such as silicone, to one or both surfaces of the material web 7. The conditioning unit 11 includes two conditioning rolls 12, which are arranged opposite one another. Each of the conditioning rolls 12 dips into a liquid container and conveys a thin liquid film from the latter onto the material web. The conditioning rolls 12, either for the application of moisture or water or for the application of silicone, for example, are arranged opposite one another, in order to permit a uniform application of the fluid. In the web travel path reproduced in FIG. 1, the material web 7 has a downwardly directed web course impressed thereon, within the downwardly directed web course, the material web 7 is provided with the liquid film, there being no deflection of the material web between the first chill roll 8 and a chill roll 14 arranged further downline. The further web path is deflected for the first time again into a part of the web path extending upwardly by the chill roll 14, i.e., the material web 7 experiences a deflection of about 180°.

At a further chill roll 15, the material web is deflected an angle of about 180°. At a further chill roll 16, the material web 7 is deflected an angle of more than 180°, but less than 270°, the material web 7 leaving this pair of chill rolls 15 and 16 in an inclined direction, the web path extending slightly upwardly to a further pair of chill rolls 17 and 18, which are arranged at least approximately in the same configuration as the two chill rolls 15 and 16 described hereinbefore. The material web 7 runs onto the first chill roll 17 of the further pair of chill rolls 17, 18 coming from the web path thereof extending at an angle, the material web 7 wrapping around the surface of the chill roll 17 of the further pair of chill rolls 17, 18 at an angle between 180° and 270°. Then, after the material web 7 has passed the surface of the first chill roll 17 of the further pair of chill rolls 17, 18, it runs into a section of the web path extending at an angle between the second chill roll 18 of the aforementioned pair of chill rolls 17, 18 and a chill roll 19.

As is further apparent from FIG. 1, the material web 7 is deflected in the manner illustrated during the travel thereof between through the chill rolls 20 and 21. After the material web 7 has left the surface of the second chill roll 21, the material web 7 travels in a horizontal direction in the cooling and conditioning unit 1. As can further be noted from FIG. 1, the chill rolls 8, 14, 15, 16, 17, 18, 19, 20 and 21 are all arranged in an offset configuration relative to one another, the first chill roll 8 being arranged in the housing 2 closer to the inlet or entry of the material web 7 into the cooling and conditioning unit 1, as compared with the chill rolls 15 and 16. By the arrangement according to the invention of the chill rolls 14, 15, 16, 17, 18, 19, 20 and 21 in an offset configuration within the housing, the height 3 of the housing is utilized effectively, it being possible for a multiplicity of chill rolls to be accommodated in a short housing 2 in relation to the housing length 4, as a result of which the housing 2 requires a minimum erection area in the printing plant or print shop.

The height 3 of the housing 2 can advantageously be utilized for accommodating the multiplicity of chill rolls 8, 14, 15, 16, 17, 18, 19, 20 and 21. Because the material web leaves the cooling and conditioning unit 1 according to the invention as closely as possible to a downline turner-bar or angle-bar superstructure, it is exposed to the environment over only a very short path, as a result of which it is possible for only a minimum boundary layer to build up on both sides of the freely moving material web.

The material web leaves the cooling and conditioning unit 1 in a direction extending at least approximately horizontally, in order to enter a turner-bar or angle-bar superstructure, which is connected upline of a longitudinal folding section of a folder or a longitudinal cutting section of a turner-bar or angle-bar superstructure, in order to produce a multiplicity of web ribbons from the material web 7.

Within the housing 2, the multiplicity of chill rolls 8, 14, 15, 16, 17, 18, 19, 20 and 21 are of such construction that they have a relatively small diameter 24, i.e., between 130 mm and 200 mm, as compared with conventional chill-roll arrangements. By virtue of the relatively generously dimensioned wrap angle of the material web 7 around the chill rolls, a high degree of heat transfer is achieved. Because the web tension at which the material web 7 is transported is determined by the equation $p[Pa]=\sigma[N/mm^2]/R[mm]$, a small chill-roll diameter 24 permits a relatively high web tension, which prevails in the material web 7 during the transport. A high degree of web tension exerted on the material web permits relatively close contact between the material web surface 7 and the surface of a corresponding chill roll which the material web 7 is just passing. In this way, the conditions for optimum heat transfer are improved. As a result of high web tensions maintained in this manner within the material web 7, additional web-tensioning rolls or air nozzles can be avoided. Because the chill rolls according to the invention are optimized with regard to a specific mass moment of inertia, within the cooling and conditioning unit 1, the rolls can be driven only based upon friction, so that an additional drive can be dispensed with. However, it is optionally possible to drive one or a number of the chill rolls according to the invention within the cooling and conditioning unit 1 with a separate drive motor.

A further advantage according to the invention, by virtue of the direct transfer of the material web 7 from the dryer outlet into the cooling and conditioning-unit inlet 6, is the fact that the material web 7 is not exposed to the surrounding atmosphere. As a result, boundary layers building up on the surfaces of the material web 7 can be eliminated. The boundary layers adhering to the surfaces of the material web 7 have the disadvantageous effect of forming an air cushion between those surfaces and the surface of the first chill roll 8 which is arranged closest to the dryer outlet 6. The air cushion in turn causes disadvantageous oil condensation on the surface of the roll, which constitutes the solubilization of the ink on the first chill roll and causes ink deposited on the surface of the first chill roll to be transferred back to the previously printed side of the material web. Because, in the device according to the invention, the material web 7 is not exposed to the surrounding atmosphere during the passage thereof from the dryer into the cooling and conditioning unit 1, the build-up of this damaging air cushion can effectively be prevented. The small diameter 24 of the chill rolls additionally permits a relatively high web tension to be maintained for close contact between the web and the heat-exchanging surfaces.

The material web 7 passes through the cooling and conditioning unit 1 at a high web travel speed, the material web 7 passing over a multiplicity of chill rolls having only a small diameter 24. The diameter of the chill rolls is relatively small in relation to the width thereof. Because the multiplicity of chill rolls 8, 14, 15, 16, 17, 18, 19, 20 and 21 are arranged in an offset configuration in relation to one another within the housing 2, it is also possible for a multiplicity of chill rolls to be accommodated in the housing 2, utilizing the overall height 3 thereof.

I claim:

1. In combination, a cooling and conditioning unit for a material web to which ink is applied on at least one side thereof, having a multiplicity of chill rolls having a diameter less than 300 mm arranged in a housing at least approximately vertically above one another, utilizing the height of the housing, the material web being guidable around the chill rolls along a web path extending at least approximately vertically, and a dryer disposed upline from the cooling and conditioning unit for drying the material web, comprising a material web outlet formed in the dryer, and a material web inlet formed in the cooling and conditioning unit, the cooling and conditioning unit being disposed immediately downline of the dryer in a manner that the material web leaving said dryer outlet immediately enters said inlet formed in the cooling and conditioning unit.

2. The cooling and conditioning unit according to claim 1, wherein the housing of the cooling and conditioning unit directly adjoins a housing of the dryer disposed upline therefrom.

3. The cooling and conditioning unit according to claim 2, wherein the housing of the cooling and conditioning unit is integrated in said dryer housing.

4. The cooling and conditioning unit according to claim 1, wherein the chill rolls are arranged so as to be offset from one another.

5. The cooling and conditioning unit according to claim 4, wherein the chill rolls are arranged so as to be offset from one another with respect to the height of the housing.

6. The cooling and conditioning unit according to claim 4, wherein the chill rolls are arranged so as to be offset from one another with respect to the length of the housing.

7. The cooling and conditioning unit according to claim 1, wherein the chill rolls are arranged in pairs above one another in a plane extending at least approximately vertically.

8. The cooling and conditioning unit according to claim 1, including two conditioning rolls disposed opposite one another, for applying a liquid film to the material web.

9. The cooling and conditioning unit according to claim 8, wherein, as viewed in the travel direction of the material web, said conditioning rolls are disposed between the first chill roll and further chill rolls.

10. The cooling and conditioning unit according to claim 1, wherein at least some of the chill rolls are motor-driven.

11. The cooling and conditioning unit according to claim 1, wherein at least some of the chill rolls are freely rotatable, non-driven rolls.

12. A dryer for drying a printed material web in a web-fed rotary printing machine, comprising a multiplicity of chill rolls having a diameter less than 300 mm arranged in a housing of the dryer, at least approximately vertically above one another, utilizing the height of the housing, in such a manner that the material web is guidable around the chill rolls along a web path extending at least approximately vertically.

13. The dryer according to claim 12, including two conditioning rolls disposed opposite one another, for applying a liquid film to the material web.

* * * * *